US006089990A

United States Patent [19]

Kimura

[11] Patent Number: 6,089,990

[45] Date of Patent: Jul. 18, 2000

[54] SET OF IRON CLUBS

[75] Inventor: Mahito Kimura, Saitama, Japan

[73] Assignee: Daiwa Seiko, Inc., Tokyo, Japan

[21] Appl. No.: 09/081,557

[22] Filed: May 20, 1998

[30] Foreign Application Priority Data

Aug. 20, 1997 [JP] Japan ..... 9-223690

[51] Int. Cl.[7] ..... A63B 53/04

[52] U.S. Cl. ..... 473/290; 473/291

[58] Field of Search ..... 473/290, 291, 473/324–350

[56] References Cited

U.S. PATENT DOCUMENTS

| | | | |
|---|---|---|---|
| 5,377,978 | 1/1995 | Lee | 473/291 |
| 5,607,363 | 3/1997 | Chou | 473/287 |
| 5,823,887 | 10/1998 | Mikame | 473/290 |
| 5,890,971 | 4/1999 | Shiraishi | 473/291 |

FOREIGN PATENT DOCUMENTS 8-322969 12/1996 Japan .

*Primary Examiner*—Sebastiano Passaniti

*Attorney, Agent, or Firm*—Liniak, Berenato, Longacre & White

[57] ABSTRACT

The present invention relates to a set of iron clubs. It is an object of the present invention to provide a set of iron clubs in which the directivity of a ball hit with an iron club belonging to a group of long iron clubs used for hitting the ball strongly so as to get distance can be stabilized and the time to close the face of the head can be made to coincide with each other so that it is easy for a player to hit a ball with the iron club. A set of iron clubs composed of a plurality of iron clubs, the club numbers of which are different from each other, are characterized in that: distances of the centers of gravity of the head bodies of groups of long iron clubs and short iron clubs are respectively set in a predetermined size range; and the distances of the centers of gravity of the group of long iron clubs are set smaller than the distances of the centers of gravity of the group of short iron clubs.

9 Claims, 3 Drawing Sheets

SET OF IRON CLUBS

BACKGROUND OF THE INVENTION

The present invention relates to a set of iron clubs and more particularly relates to a set of iron clubs in which the directivity of a golf ball, which has been hit by the iron clubs, can be stabilized.

As everybody knows, a set of iron clubs are composed of a plurality of iron clubs including long iron clubs and short iron clubs, the club numbers of which are 3 to 9, and also including a sand wedge club and a pitching wedge club.

Conventionally, the above set of iron clubs are composed as follows. A shaft of the long iron club is made long so that it can get distance. Since ball control is important in the short iron club, a loft angle of the head is gradually increased as the club number increases so that the ball can spin backward sharply.

In this connection, when an average golfer plays golf with this set of iron clubs, there is a tendency that the head is open when he hits a ball with the long iron club, so that the ball is sliced. On the contrary, there is a tendency that the face is closed when the player hits a ball with the short iron club, the shaft length of which is small, so that the ball is hooked. Especially, when the player uses the long iron club with which a ball is hit strongly so as to get distance, the swing speed is higher than that of the short iron club in which importance is attached to controlling of the ball. Therefore, when the player hits the ball with the long iron club, the head tends to open and the ball which has been hit with the long iron club tends to slice. For the above reasons, most players feels that it is difficult to hit a ball with the long iron clubs, the club numbers of which are low.

Depending upon a player, a ball is hit strongly not only with the long iron club but also the middle iron club, the club number of which is 5 to 7. Also, in this case, the swing speed is so high that the head tends to open and the ball is sliced. Accordingly, most players have a feeling that it is difficult to hit a ball with an iron club.

In order to prevent a ball from being sliced and hooked, a number of proposals have been made until now.

FIG. 5 is a view showing a main body of the head of the iron club disclosed in Japanese Unexamined Patent Publication No. 8-322969. This set of iron clubs are composed as follows. As shown in FIG. 6, as the club number is increased from the long iron club to the short iron club, inset A of the head body 1 is gradually decreased, that is, a distance from axis L of the shaft to a front end portion of the head body 1 on the heel side is gradually decreased.

When inset A of the head body 1 is increased, distance B of the center of gravity of the head body 1 is shortened, that is, a distance of a straight line from the center G of gravity of the head body 1 to shaft axis L is shortened. Accordingly, when a player hits a ball with this golf club, it becomes easy for him to close the face of the head. Therefore, when this long iron club is used, it become possible to prevent the occurrence of slice. In the short iron club, distance B of the center of gravity is extended. Therefore, it is difficult for the face of the head to be closed. Accordingly, the occurrence of hook can be prevented.

However, when the inset is gradually changed as described above, time to close the face of the head becomes different from each other for each club number. As a result, it becomes difficult for a player to hit a ball with the iron club of this set of iron clubs.

SUMMARY OF THE INVENTION

The present invention has been accomplished in the above circumstances. It is an object of the present invention to provide a set of iron clubs in which the directivity of a ball hit with an iron club belonging to a group of long iron clubs used for hitting the ball strongly so as to get distance can be stabilized and the time to close the face of the head can be made to coincide with each other so that it becomes easy for a player to hit a ball with the iron club.

In order to solve the above problems, the invention provides a set of iron clubs composed of a plurality of iron clubs, the club numbers of which are different from each other, characterized in that: distances of the centers of gravity of the head bodies of groups of long iron clubs and short iron clubs are respectively set in a predetermined size range; and the distances of the centers of gravity of the group of long iron clubs are set smaller than the distances of the centers of gravity of the group of short iron clubs.

The invention further provides a set of iron clubs, wherein the group of long iron clubs includes iron clubs, the club numbers of which are not more than 4, the group of short iron clubs includes iron clubs, the club numbers of which are not less than 8, and the group of long iron clubs and the group of short iron clubs are separated from each other by either of the iron clubs, the club numbers of which are 5 to 7.

The invention further provides a set of iron clubs, wherein a difference between the maximum and the minimum of the distance of the center of gravity is not more than 1.5 mm (preferably, not more than 1.0 mm) in the groups of long iron clubs and short iron clubs. The invention further provides a set of iron clubs, wherein a difference between the maximum of the distance of the center of gravity of the group of long iron clubs and the minimum of the distance of the center of gravity of the group of short iron clubs is not less than 2 mm.

According to the invention, the distance of the center of gravity of a long iron club belonging to a group of long iron clubs used for hitting a ball strongly is made shorter than the distance of the center of gravity of a short iron club belonging to a group of short iron clubs. Accordingly, it is easy to close the face of the head of the long iron club when a player hits a ball. Therefore, the occurrence of slice can be prevented, and the ball is sent in a predetermined direction.

Further, according to the invention, a set of iron clubs can be divided into two groups. One is a group of long iron clubs with which a ball is hit strongly, and the other is a group of short iron clubs in which importance is attached to controlling of a ball that has been hit with the iron clubs. In the group of long iron clubs, the distances of the centers of gravity are substantially set at a constant value, and also in the group of short iron clubs, the distances of the centers of gravity are substantially set at a constant value. Accordingly, the time to close the face of the head of the iron club can be made to coincide with each other in each group.

DETAILED DESCRIPTION OF THE PREFERRED EMBODIMENTS

Referring to the accompanying drawings, embodiments of the present invention will be explained in detail as follows.

Figure 1:
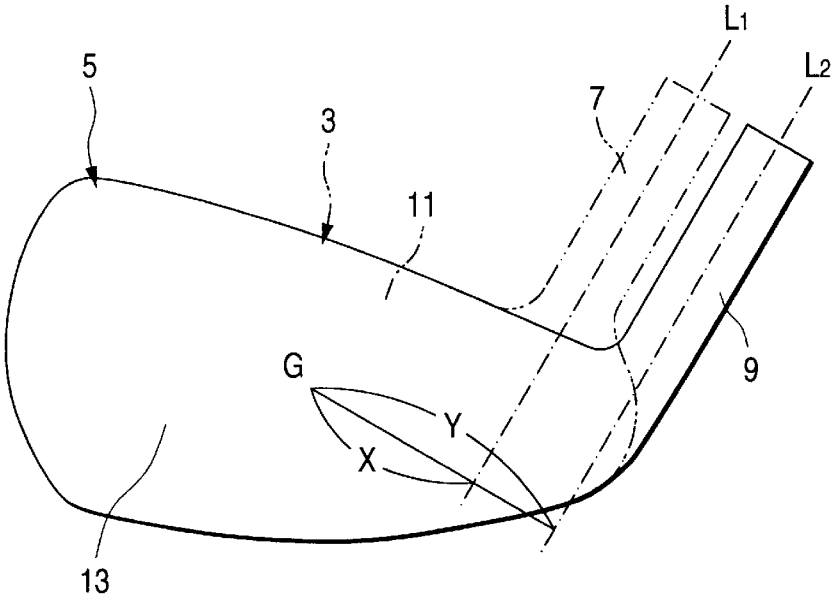
FIG. 1 is a front view of the head body of the number five iron club in the set of iron clubs according to the first embodiment.

In FIG. 1, reference numeral 3 is a head body of the number five iron club in the set of iron clubs of the first embodiment according to the invention, and reference numeral 5 is a head body of the number seven iron club. Hosel sections 7, 9 and face sections 11, 13 of the head bodies 3, 5 are made of stainless steel or titanium by means of integral molding, and the loft angle is set in such a manner that it is increased as the club number is increased.

Although not shown in the drawing, the same recess-shaped cavities as those of the conventional iron clubs are formed in the back sections of the head bodies 3, 5. When the cavities are provided in the head bodies 3, 5 as described above, weights of the head bodies 3, 5 are dispersed to the peripheries of the heads, so that a high moment of inertia can be obtained when a ball is hit with the iron clubs.

Figure 5:
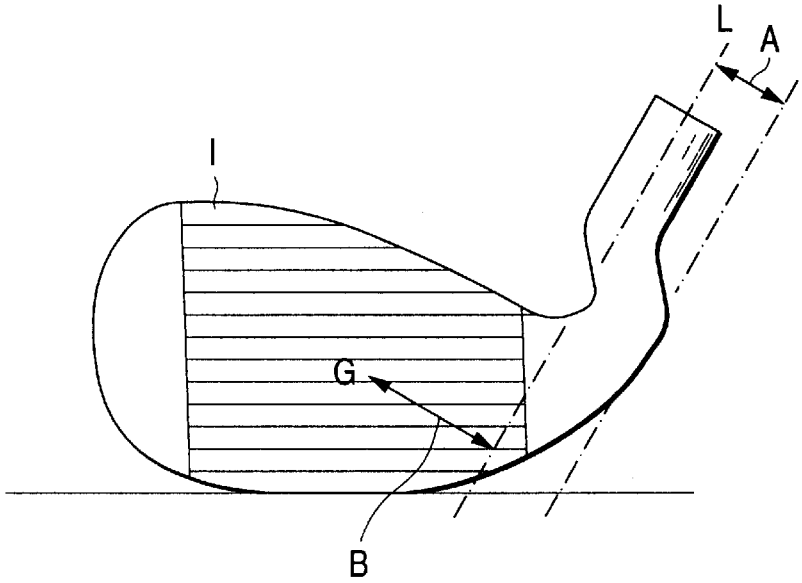
FIG. 5 is a front view of the head body of an iron club in a set of conventional iron clubs.
Figure 6:
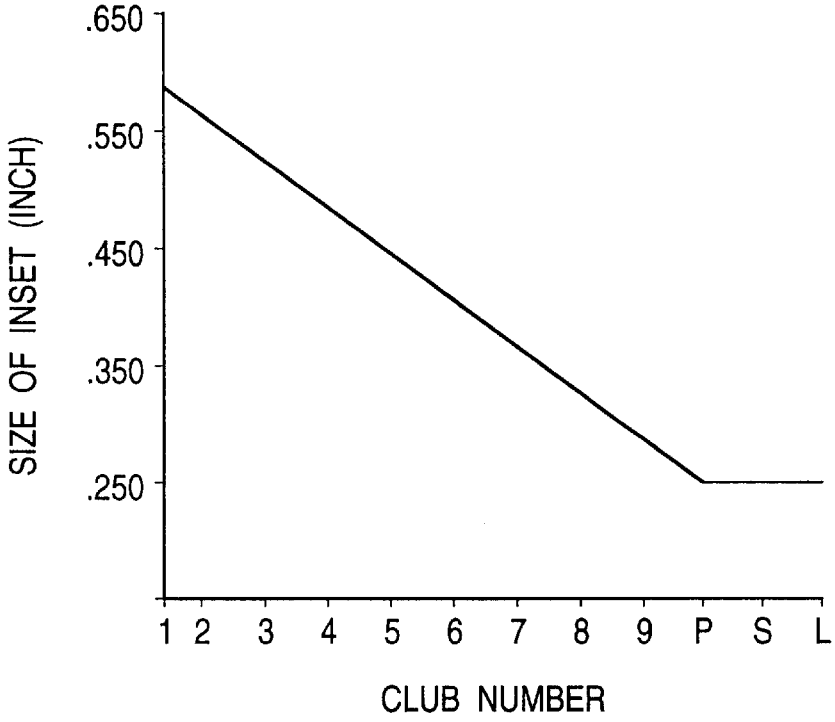
FIG. 6 is a graph showing a transition of the inset of the conventional iron club, wherein this graph is drawn for each club number.

In this connection, except for the conventional example shown in FIG. 5, distances of the centers of gravity of the heads of the conventional iron clubs of all club numbers are set substantially constant.

Figure 2:
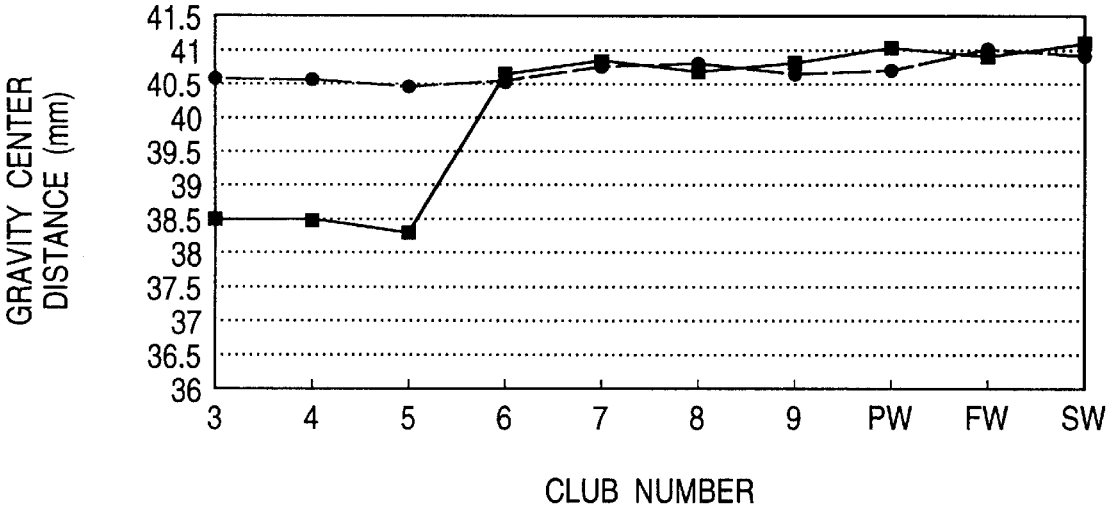
FIG. 2 is a graph showing a transition of the distance of the center of gravity of the set of iron clubs of the first embodiment, wherein this graph is drawn for each club number.

In the conventional example shown on Table 1, there is shown a standard set of iron clubs in which the area of the face of the number five iron club is 35.5 $cm^2$. In this set of iron clubs which are shown on Table 1 and also shown on FIG. 2 by a broken line, the distances of the centers of gravity of iron clubs of all club numbers are made to be substantially constant in a range from 40.5 to 41.1 mm.

TABLE 1

| a | 3 | 4 | 5 | 6 | 7 | 8 | 9 | PW | FW | SW |
|---|---|---|---|---|---|---|---|---|---|---|
| b | 40.6 | 40.6 | 40.5 | 40.6 | 40.7 | 40.8 | 40.6 | 40.7 | 41.0 | 40.9 |
| c | 38.5 | 38.5 | 38.3 | 40.7 | 40.8 | 40.7 | 40.8 | 41.0 | 40.9 | 41.1 |

a Club number
b Conventional Example
c Embodiment

However, the above structure of the long iron club is disadvantageous in that the head is open when a ball is hit with this long iron club and the ball is sliced. Also, the above structure of the short iron club is disadvantageous in that the head is closed when a ball is hit with this short iron club and the ball is hooked.

Therefore, this embodiment is composed as follows. In a standard set of iron clubs in which the area of the face of the head 3 of the number five iron club is 35.5 $cm^2$, the hosel section 7 of the head body 3 is displaced to the toe side of the head body 3 compared with the hosel section 9 of the head body 5 as shown in FIG. 1. Due to the foregoing, distance X of the center of gravity of the head body 3 is made to be 38.3 mm which is shorter than distance Y of the center of gravity of the head body 5. In this case, distance X of the center of gravity of the head body 3 is a length of a straight line which passes through the center G of gravity of the head body 3 perpendicularly to axis $L_1$ of the shaft, and distance Y of the center of gravity of the head body 5 is a length of a straight line which passes through the center G of gravity of the head body 5 perpendicularly to axis $L_2$ of the shaft.

Further, in this embodiment, iron clubs, the club numbers of which are 3 to 5, are assumed to be a group of long iron clubs with which a ball is strongly hit. Therefore, the hosel sections of the number three iron club and the number four iron club are displaced to the toe side of the head body in the same manner as described above. Due to the foregoing, as shown on FIG. 2 and Table 1, the distances of the centers of gravity of the number three iron club and the number four iron club are respectively set at 38.5 mm. In this way, the distances of the centers of gravity of the number three, four and five iron club are made to be shorter than those of the conventional iron clubs, and further the tolerances of these distances of the centers of gravity are set at a substantial constant value of not higher than 1 mm.

On the other hand, in this embodiment, iron clubs, the club numbers of which are not less than six, are assumed to be a group of short iron clubs in which importance is attached to controlling of a ball to be hit with the iron clubs, and each hosel section is arranged at the substantially same position as that of the above hosel section 9. The distances of the centers of gravity are set at the substantially same size as that of the conventional distance of the center of gravity in the tolerance not more than 1 mm as shown on FIG. 2 or Table 1. Due to the foregoing, a difference between the maximum of the distance of the center of gravity of the group of long iron club and the minimum of the distance of the center of gravity of the group of short iron club is set at a value not less than 2 mm, and the distances of the centers of gravity of the group of long iron clubs are made shorter than the distances of the centers of gravity of the group of short iron clubs.

As described above, in this embodiment, the distances of the centers of gravity of the group of long iron clubs with which a ball is hit strongly are made shorter than those of the conventional long iron clubs. Therefore, it is easy for a player to close the face of the head when he hits a ball. Accordingly, it is possible to prevent the occurrence of slice in the case of hitting a ball, and the ball is sent to a desired direction.

Further, as described above, the distances of the centers of gravity of the group of long iron clubs with which a ball is strongly hit are set at a substantially constant value, and the distances of the centers of gravity of the group of short iron clubs in which importance is attached to controlling of a ball are set at a substantially constant value. Accordingly, the time to close the face of the head can be made to coincide in each group.

Therefore, according to the present embodiment, when a player hits a ball with a long iron club belonging to the group of long iron clubs with which the ball is strongly hit so as to get distance, there is no possibility that the head of the long iron club is open and that the ball is sliced when the player hits the ball. As a result, it becomes possible for a large number of players, who have a feeling of difficulty of hitting a ball strongly with long iron clubs, to hit a ball beautifully.

Further, according to the present embodiment, a set of iron clubs can be divided into two groups. One is a group of long iron clubs with which a ball is hit strongly, and the other is a group of short iron clubs in which importance is attached to controlling of a ball to be hit with the iron clubs. That is, it is possible for a player to use the iron clubs properly. In the group of long iron clubs, the distances of the centers of gravity are substantially set at a constant value, and also in the group of short iron clubs, the distances of the centers of gravity are substantially set at a constant value. Accordingly, the time to close the face of the head of the iron club when a player hits a ball can be substantially the same with each other. As a result, it is possible for a player to hit a ball with the iron club of this embodiment more easily than the conventional iron club shown in FIG. 5.

Figure 3:
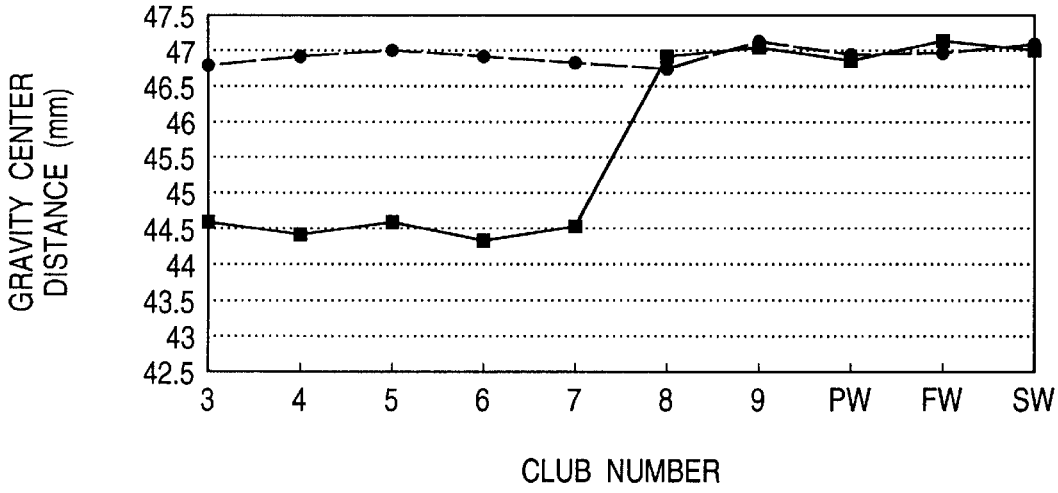
FIG. 3 is a graph showing a transition of the distance of the center of gravity of the set of iron clubs of the second embodiment, wherein this graph is drawn for each club number.

FIG. 3 and Table 2 show a transition of the distances of the centers of gravity of the set of iron clubs of the second embodiment. In this embodiment, the present invention is applied to a set of iron clubs, the number five iron club of which has a face area of 41.9 $cm^2$, that is, these iron clubs are composed of heads of over-size. In this set of iron clubs which are shown on Table 2 and also shown on FIG. 3 by a broken line, the distances of the centers of gravity of iron clubs of all club numbers are made to be substantially constant in a range from 46.7 to 47.1 mm.

TABLE 2

| a | 3 | 4 | 5 | 6 | 7 | 8 | 9 | PW | FW | SW |
|---|---|---|---|---|---|---|---|---|---|---|
| b | 46.8 | 46.9 | 47.0 | 46.9 | 46.8 | 46.7 | 47.1 | 46.9 | 46.9 | 47.0 |
| c | 44.6 | 44.4 | 44.6 | 44.3 | 44.5 | 46.9 | 47.0 | 46.8 | 47.1 | 46.9 |

a Club number
b Conventional Example
c Embodiment

In this embodiment, in the set of iron clubs composed of the above heads of over-size, iron clubs, the club numbers of which are 3 to 7, are assumed to be a group of long iron clubs with which a ball is strongly hit. When the hosel section of each iron club is displaced to the toe side of the head body, the distance of the center of gravity of the head body is set in a range from 44.3 to 44.6 mm which is shorter than the distance of the center of gravity of the conventional iron club, and the tolerance is set to be not more than 1 mm.

In this embodiment, iron clubs, the club numbers of which are not less than eight, are assumed to be a group of short iron clubs in which importance is attached to controlling of a ball to be hit with the iron clubs, and each hosel section is arranged at the substantially same position as that of the hosel section of-the conventional iron club. The distances of the centers of gravity are set at the substantially same size as that of the conventional distance of the center of gravity in the tolerance not more than 1 mm. Due to the foregoing, a difference between the maximum of the distance of the center of gravity of the group of long iron club and the minimum of the distance of the center of gravity of the group of short iron clubs is set at a value not less than 2 mm, and the distances of the centers of gravity of the group of long iron clubs are made shorter than the distances of the centers of gravity of the group of short iron clubs.

Since the present embodiment is composed as described above, in the same manner as that of the first embodiment, the distances of the centers of gravity of the group of long iron clubs with which a ball is strongly are made short. Therefore, it is easy for a player to close the face of the head when he hits a ball. Accordingly, it is possible to prevent the occurrence of slice in the case of hitting a ball, and the ball is sent to a desired direction.

Further, as described above, the distances of the centers of gravity of the group of long iron clubs with which a ball is strongly hit are set at a substantially constant value, and the distances of the centers of gravity of the group of short iron clubs in which importance is attached to controlling of a ball are set at a substantially constant value. Accordingly, the time to close the face of the head can be the same with each other in each group.

Therefore, according to the present embodiment, when a player hits a ball with a long iron club belonging to the group of long iron clubs with which the ball is strongly hit so as to get distance, there is no possibility that the head of the long iron club is open and that the ball is sliced when the player hits the ball. As a result, it becomes possible for a large number of players, who have a feeling of difficulty of hitting a ball strongly with long iron clubs, to hit a ball beautifully.

Further, according to the present embodiment, a set of iron clubs can be divided into two groups. One is a group of long iron clubs with which a ball is hit strongly, and the other is a group of short iron clubs in which importance is attached to controlling of a ball to be hit with the iron clubs. That is, it is possible for a player to use the iron clubs properly. In the group of long iron clubs, the distances of the centers of gravity are substantially set at a constant value, and also in the group of short iron clubs, the distances of the centers of gravity are substantially set at a constant value. Accordingly, the time to close the face of the head of the iron club when a player hits a ball can be the same with each other. As a result, it is possible for a player to hit a ball with the iron club of this embodiment more easily than the conventional iron club shown in FIG. 5.

Figure 4:
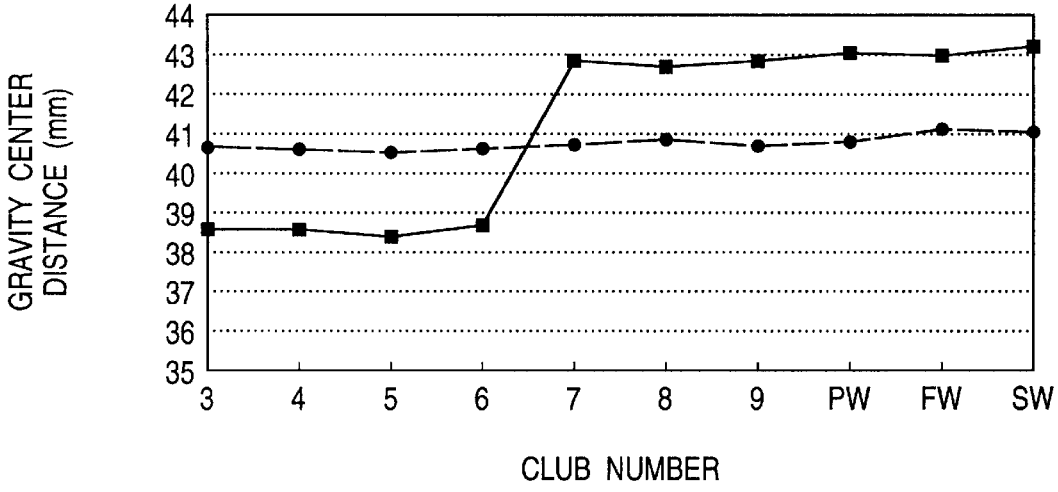
FIG. 4 is a graph showing a transition of the distance of the center of gravity of the set of iron clubs of the third embodiment, wherein this graph is drawn for each club number.

FIG. 4 and Table 3 show a transition of the distances of the centers of gravity of the set of iron clubs of the third embodiment. In this embodiment, the present invention is applied to the standard set of iron clubs described in the first embodiment.

The present embodiment will be described in detail. In this embodiment, iron clubs, the club numbers of which are 3 to 6, are assumed to be a group of long iron clubs with which a ball is strongly hit. When the hosel section of each iron club is displaced to the toe side of the head body, the distance of the center of gravity of the head body is set in a range from 38.3 to 38.6 mm which is shorter than the distance of the center of gravity of the conventional iron club.

TABLE 3

| a | 3 | 4 | 5 | 6 | 7 | 8 | 9 | PW | FW | SW |
|---|---|---|---|---|---|---|---|---|---|---|
| b | 40.6 | 40.6 | 40.5 | 40.6 | 40.7 | 40.8 | 40.6 | 40.7 | 41.0 | 40.9 |
| c | 38.5 | 38.5 | 38.3 | 38.6 | 42.8 | 42.7 | 42.8 | 43.0 | 42.9 | 43.1 |

a Club number
b Conventional Example
c Embodiment

In this embodiment, iron clubs, the club numbers of which are not less than seven, are assumed to be a group of short iron clubs in which importance is attached to controlling of a ball to be hit with the iron clubs, and each hosel section of each iron club is displaced to the heel side of the head body. Due to the foregoing, the distance of the center of gravity is set in a range from 42.7 to 43.1 mm which is longer than the conventional distance of the center of gravity, and a difference between the maximum of the distance of the center of gravity of the group of long iron club and the minimum of the distance of the center of gravity of the group of short iron club is set at a value not less than 2 mm, and the distances of the centers of gravity of the group of long iron clubs are made shorter than the distances of the centers of gravity of the group of short iron clubs.

According to the present embodiment composed as described above, in the same manner as that of the first embodiment, the distances of the centers of gravity of the group of long iron clubs with which a ball is hit strongly are made shorter than those of the conventional iron clubs. Therefore, it is easy for a player to close the face of the head when he hits a ball. Accordingly, it is possible to prevent the occurrence of slice in the case of hitting a ball, and the ball is sent to a desired direction.

In the group of short iron clubs in which importance is attached to controlling of a ball to be hit with the iron clubs, the distances of the centers of gravity are longer than those of the conventional iron clubs. Accordingly, when a player hits a ball with the iron club, the face of the head is difficult to be closed. Therefore, the occurrence of hook is prevented and the ball is sent to a desired direction.

Further, as described above, the distances of the centers of gravity of the group of long iron clubs with which a ball is strongly hit are set at a substantially constant value, and the distances of the centers of gravity of the group of short iron clubs in which importance is attached to controlling of a ball are set at a substantially constant value. Accordingly, the time to close the face of the head can be the same in each group.

Therefore, according to the present embodiment, when a player hits a ball with a long iron club belonging to the group of long iron clubs with which a ball is strongly hit so as to get distance, there is no possibility that the head of the long iron club is open and that the ball is sliced when the player hits the ball. As a result, it becomes possible for a large number of players, who have a feeling of difficulty of hitting a ball strongly with long iron clubs, to hit a ball beautifully.

According to the present embodiment, in the group of short iron clubs in which importance is attached to controlling of a ball to be hit with the iron clubs, the distances of the centers of gravity are longer than those of the conventional iron clubs. Accordingly, when a player hits a ball with the iron club, the face of the head is difficult to be closed. Therefore, the occurrence of hook is prevented.

Further, according to the present embodiment, a set of iron clubs can be divided into two groups. One is a group of long iron clubs with which a ball is hit strongly, and the other is a group of short iron clubs in which importance is attached to controlling of a ball to be hit with the iron clubs. That is, it is possible for a player to use the iron clubs properly. In the group of long iron clubs, the distances of the centers of gravity are substantially set at a constant value, and also in the group of short iron clubs, the distances of the centers of gravity are substantially set at a constant value. Accordingly, the time to close the face of the head of the iron club when a player hits a ball can be the same with each other. As a result, it is possible for a player to hit a ball with the iron club of this embodiment more easily than the conventional iron club shown in FIG. 5.

In this connection, in the embodiments described above, when the hosel section is displaced to the toe or heel side of the head body, the distance of the center of gravity of the head body is adjusted. However, it is possible to change the distance of the center of gravity by changing the shape of the head body or attaching a weight member to the head body.

As described above, according to the set of iron club of the invention, it is possible to prevent the occurrence of slice when a player hits a ball with an iron club belonging to a group of long iron clubs. Therefore, it is possible to send the ball in a desired direction.

Further, according to the present embodiment, a set of iron clubs can be divided into two groups. One is a group of long iron clubs with which a ball is hit strongly, and the other is a group of short iron clubs in which importance is attached to controlling of a ball be hit with the iron clubs. That is, it is possible for a player to use the iron clubs properly. In the group of long iron clubs, the distances of the centers of gravity are substantially set at a constant value, and also in the group of short iron clubs, the distances of the centers of gravity are substantially set at a constant value. Accordingly, the time to close the face of the head of the iron club when a player hits a ball can be the same with each other. As a result, it is possible for a player to hit a ball with the iron club of this embodiment more easily than the conventional iron club.

What is claimed is:

1. A set of iron clubs composed of a plurality of iron clubs, the club numbers of which are different from each other, wherein said iron clubs are divided into a long iron club group and a short iron club group, each of the iron clubs in said long iron club group has a gravity center distance in a first predetermined substantially constant size value, each of the iron clubs in said short iron club group has a gravity center distance in a second predetermined substantially constant size value, a maximum gravity center distance of said first predetermined substantially constant size value is smaller than a minimal gravity center distance of said second predetermined substantially constant size value;

wherein said gravity center distance is a minimal distance between a gravity center of a head body and an axis of a shaft.

2. A set of iron clubs according to claim 1, wherein said long iron club group includes iron clubs the club numbers of which are not more than 4, and said short iron club group includes iron clubs the club numbers of which are not less than 8.

3. A set of iron clubs according to claim 1, wherein a first difference between said maximum gravity center distance of said first predetermined substantially constant size value and a minimal gravity center distance of said first predetermined substantially constant size value is not more than 1.5 mm, and a second difference between a maximum gravity center distance of said second predetermined substantially constant size value and said minimal gravity center distance of said second predetermined substantially constant size value is not more than 1.5 mm.

4. A set of iron clubs according to claim 3, wherein each of said first and second differences is not more than 1.0 mm.

5. A set of iron clubs according to claim 1, wherein a difference between said maximum gravity center distance of said first predetermined substantially constant size value and said minimal gravity center distance of said second predetermined substantially constant size value is not less than 2.0 mm.

6. A set of iron clubs according to claim 1, wherein a first difference is defined between said maximum gravity center distance of said first predetermined substantially constant size value and a minimal gravity center distance of said first predetermined substantially constant size value, a second difference is defined between a maximum gravity center distance of said second predetermined substantially constant size value and said minimal gravity center distance of said second predetermined substantially constant size value, and a third difference is defined between said maximum gravity center distance of said first predetermined substantially constant size value and said minimal gravity center distance of said second predetermined substantially constant size value, and wherein each of said first and second differences is smaller than said third difference.

7. A set of iron clubs according to claim 1, wherein a gravity center distance of each of the clubs having club numbers of 3 to 5 is substantially 38.5 mm, and a gravity center distance of each of the clubs having club numbers of 6 and more is substantially 40.8 mm.

8. A set of iron clubs according to claim 1, wherein a gravity center distance of each of the clubs having club numbers of 3 to 7 is substantially 44.4 mm, and a gravity center distance of each of the clubs having club numbers of 8 and more is substantially 46.9 mm.

9. A set of iron clubs according to claim 1, wherein a gravity center distance of each of the clubs having club numbers of 3 to 6 is substantially 38.5 mm, and a gravity center distance of each of the clubs having club numbers of 7 and more is substantially 42.8 mm.

* * * * *